US005226439A

United States Patent [19]

O'Keeffe et al.

[11] Patent Number: 5,226,439

[45] Date of Patent: Jul. 13, 1993

[54] SUPPORT DEVICE FOR USE WITH CHAIRS

[76] Inventors: Henry J. O'Keeffe; Patricia D. O'Keeffe, both of 32220 Highway 50, Malin, Oreg. 97632

[21] Appl. No.: 753,148

[22] Filed: Aug. 30, 1991

[51] Int. Cl.[5] ..... A45B 3/00

[52] U.S. Cl. ..... 135/66; 135/75; 256/1; 256/59; 297/DIG. 10; 4/254

[58] Field of Search ..... 135/65–67, 135/116, 74, 75; 4/254; 297/217, DIG. 10; 5/81 R; 256/1, 59

[56] References Cited

U.S. PATENT DOCUMENTS

| | | | |
|---|---|---|---|
| 2,596,055 | 5/1952 | Thomas . | |
| 2,757,388 | 8/1956 | Chisholm | 135/65 X |
| 3,047,884 | 8/1962 | Grondona . | |
| 3,157,185 | 11/1964 | Schoenike | 135/116 X |
| 3,176,322 | 4/1965 | Mulcahy . | |
| 3,465,765 | 9/1969 | Dietz | 135/116 X |
| 3,739,793 | 6/1973 | Wilson | 135/67 X |
| 4,314,576 | 2/1982 | McGee | 135/67 |
| 4,474,202 | 10/1984 | Blechner | 135/67 |
| 4,621,804 | 11/1986 | Mueller | 135/67 X |
| 4,844,107 | 7/1989 | Watkins | 135/67 X |
| 4,894,871 | 1/1990 | Schmerler | 135/67 X |
| 4,922,560 | 5/1990 | Skibinski | 135/67 X |
| 4,995,412 | 2/1991 | Hirn et al. | 135/67 |
| 5,007,618 | 4/1991 | Libby | 135/65 X |

*Primary Examiner*—Carl D. Friedman
*Assistant Examiner*—Lan M. Mai
*Attorney, Agent, or Firm*—Henderson & Sturm

[57] ABSTRACT

A support device (10) for use with chairs (100) wherein the support device (10) includes an enlarged generally flat rectangular base member (13) provided with a pair of adjustable support arm members (15) on its sides wherein the weight of the chair (100) enhances the frictional engagement of the bottom surface (13") of the base member (13) with the floor even before the user attempts to sit in the chair (100) or otherwise comes into contact with the support device (10).

13 Claims, 2 Drawing Sheets

SUPPORT DEVICE FOR USE WITH CHAIRS

TECHNICAL FIELD

The present invention relates to support devices in general for allowing a person to get into and out of a particular position, and in particular to a support device that is specifically designed to assist the user in sitting in and rising from a chair.

BACKGROUND ART

As can be seen by reference to the following U.S. Pat. Nos. 3,739,793; 3,047,884; 2,596,055 and 3,176,322; the prior art is replete with myriad and diverse support aids for assisting a user in getting into and out of various domestic articles such as beds, chairs, toilets, baths, and the like.

While all of the aforementioned prior art constructions are more than adequate for the basic purpose and functions for which they have been specifically designed, these patented devices are uniformly deficient with regard to the fact that they are inherently laterally unstable and require the downward application of the users weight to provide the frictional engagement between the bottom of the support device and the surface upon which it rests to counteract the inherent lateral instability.

As a consequence of the foregoing situation, there has existed a longstanding need among a large number of infirm individuals for a support device that not only has an enlarged surface area bearing surface to produce lateral stability; but, also a device that employs the weight of a chair to compound the effective stabilizing function of the device; and, the provision of such a construction is a stated objective of the present invention.

DISCLOSURE OF THE INVENTION

Briefly stated, the support device that comprises the basis of the present invention comprises a base unit and a pair of support arm units disposed on opposite sides of the base unit.

In addition the base unit comprises an enlarged surface area base member that is dimensioned to fit under and project beyond the sides of a conventional chair; wherein, the legs of the chair are in contact with the upper surface of the base member to increase the frictional engagement of the bottom surface of the base member with a horizontal support surface such as a covered or uncovered floor.

As will be explained in greater detail further on in the specification, not only does the weight of the chair compound the effective weight of the device; but, the enlarged frictional contact surface of the base member is further enhanced by the weight of the user to virtually insure that there will be no lateral displacement of the device while the user is attempting to either sit down in the chair or rise to a standing position relative to the chair.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
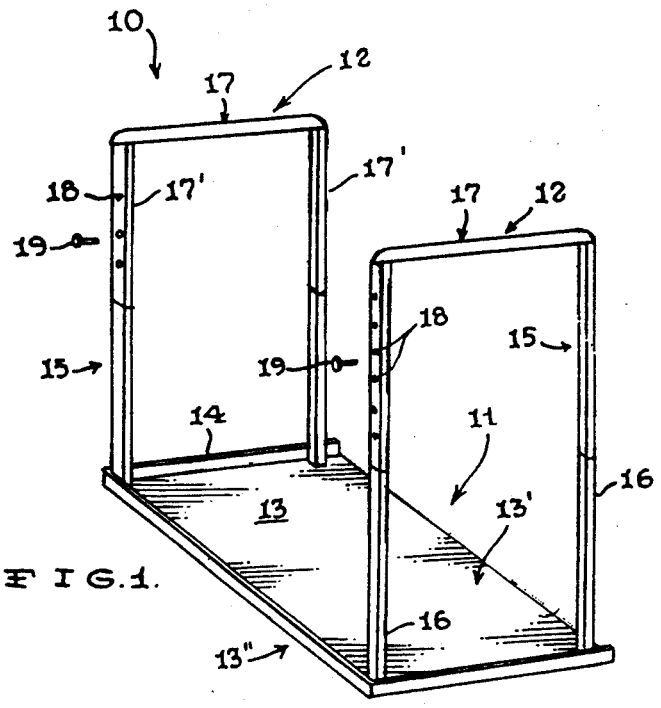
FIG. 1 is an isolated perspective view of the support device.

As can be seen by reference to the drawings, and in particular to FIG. 1, the support device that forms the basis of the present invention is designated generally by the reference numeral (10). The device (10) comprises in general a base unit (11) and a pair of support arm units (12). These units will now be described in seriatim fashion.

As can best be seen by reference to FIG. 1, the base unit (11) comprises an enlarged generally flat rectangular base member (13) having a top surface (13') and a bottom surface (13").

In addition the top surface (13') is further provided with a protective railing element (14) which extends around at least a portion of the periphery of the base member (13) including both sides and at least one among the front and back sides of the base member (13); wherein, the purpose and function of the railing element (14) will be described presently.

As shown in FIGS. 1 through 4, the support arm units (12) each comprise a generally inverted U-shaped support arm member (15) including a pair of vertical support posts (16) connected on their lower ends to the base member (13) and opposed sections of the railing element (14); and, operatively connected on their upper ends by a generally inverted U-shaped cap (17) wherein the downwardly depending arms (17') of the cap are provided with a plurality of apertures (18).

Figure 2:
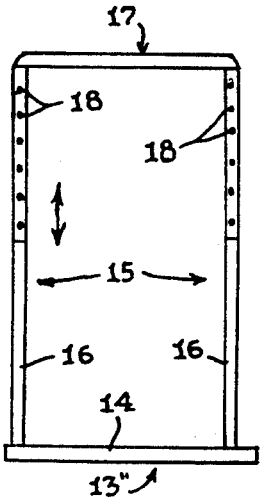
FIG. 2 is a side plan view of the device.

As can best be seen by reference to FIGS. 1 and 2 the cap (17) is dimensioned to slideably engage the vertical support posts (16) which are each further provided with a complimentary aperture (not shown) that may be aligned with one of the plurality of apertures (18) in the cap (17) so as to receive a fastener member (19); such that the cap (17) may be vertically adjusted relative to the support posts (16), to vary the effective height of each of the support arm members (15) relative to the base member (13) in a well recognized fashion.

Figure 3:
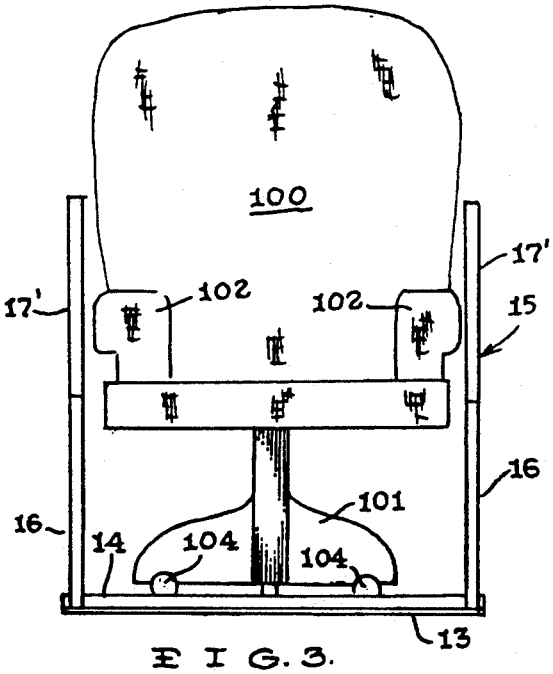
FIG. 3 is a front plan view of the device in conjunction with a chair.
Figure 4:
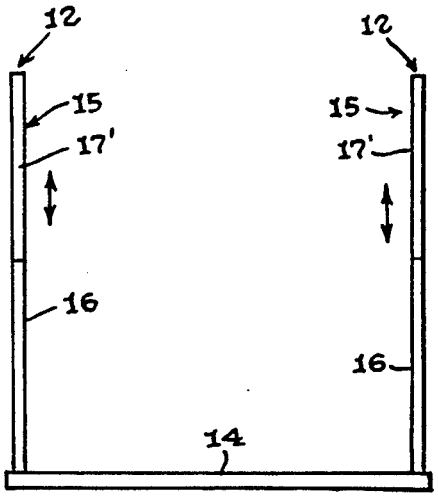
FIG. 4 is an isolated front plan view of the device.

Turning now to FIGS. 1 and 3 it can be appreciated that the base member (13) is dimensioned to not only easily accommodate a conventional chair (100) wherein the legs (101) of the chair (100) will rest upon the top surface (13') of the base member (13); but it is further dimensioned to extend beyond the arms (102) of the chair (100); wherein, the support arm members (15) are disposed proximate to, but spaced from the sides of the arms of the chair (100).

It can also be appreciated at this juncture that the protective railing element (14) is provided to not only provide rigidity and support to the support posts (16); but, to also limit the rearward displacement of the chair legs (101) as the user stands up; particularly in those instances wherein the chair (100) is provided with wheeled casters (104) as depicted in FIG. 3.

As mentioned previously the weight of the chair (100) increases the frictional engagement of the bottom surface (13") of the device with the floor; wherein, in the preferred embodiment of the invention the bottom surface (13") of the base member (13) is provided with a high coefficient of friction coating, such as rubber or the like.

It should also be appreciated that due to the vertically adjustable nature of the support arm units (12) the height of the support arm units (12) may be selected so as to insure that the users maximum weight will be transferred to the base member (13) by any contact with the arm members (15), the top surface (13') of the base member (13) or the chair (100) itself to preclude lateral translation of the support device (10) as the user gets into and out of the chair (100).

Also in the alternate version of the preferred embodiment depicted in FIG. 5, it can be seen that not only does this invention contemplate a vertically adjustable arrangement for the support device (10); but, it also envisions a laterally adjustable arrangement, as will be explained presently.

Figure 5:
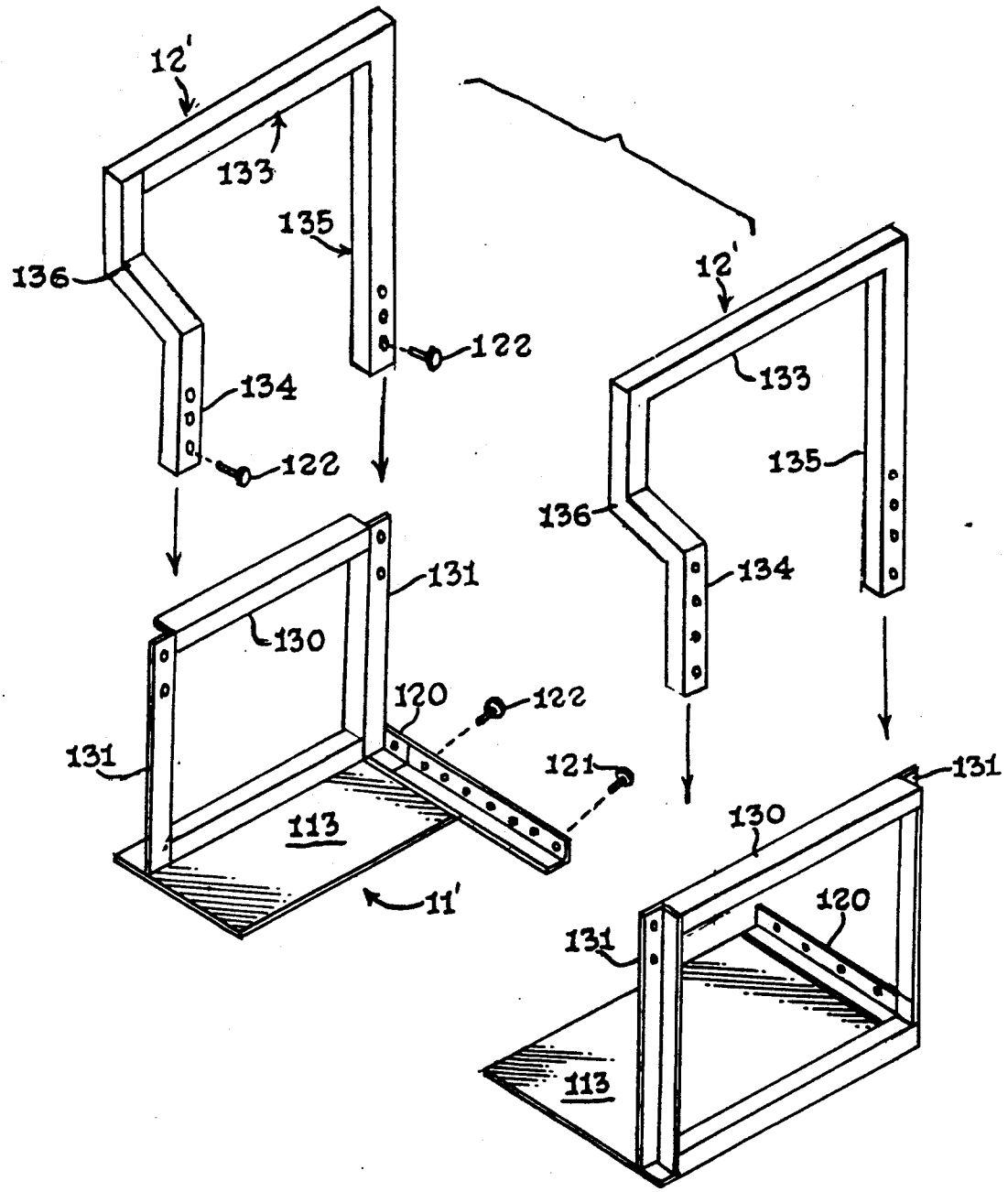
FIG. 5 is an exploded perspective view of an alternate version of the preferred embodiment.

In the alternate version of the preferred embodiment depicted in FIG. 5, it can be seen that the base unit (11') comprises a pair of generally flat rectangular base members (113) having an apertured generally L-shaped flange element (120) formed on the trailing edge of each base member (113); and, an intermediate apertured generally L-shaped flange connector element (121) adapted to be secured to the flange elements (120) on each of the base members (113) via fastening means (122) to vary the spacing between the base members (113).

As can also be seen by reference to FIG. 5 the arm units (12') each comprise a pair of lower generally open rectangular framework members (130) vertically disposed on the outboard edges of each of the base members (113); wherein, the sides of the framework members (130) are provided with apertured outwardly projecting generally flat flanges (131), whose purpose and functions will be explained presently.

Still referring to FIG. 5, it can be seen that the arm units (12') also comprise a pair of upper generally inverted U-shaped framework members (133) having apertured front (134) and rear (135) legs; wherein, the front legs (134) are further provided with outwardly projecting hand grip portions (136) to assist the user in exiting from a chair (not shown) which rests on the base members (113).

In this particular version, the apertured legs (134) (135) of the upper framework members (133) are adapted to be aligned with, and secured by fastening members (122) to, selective apertures in the apertured flanges (131) in the lower framework members (130) to vary the height of the upper framework members (133) relative to the lower framework members (130).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A support device for use with a conventional chair having opposite sides and a base; wherein, the device consists of:

a generally flat base unit having front rear and side edges; wherein, the base unit is dimensioned to accommodate the base of the chair and extend beyond the sides of the chair;

a pair of generally rectangular adjustable support arm units extending from the front edge to the rear edge of the base unit, and having upper and lower portions; wherein, the lower portions are operatively connected proximate to the side edges of the base unit and disposed proximate to, but spaced from, the opposite sides of the chair; and, a generally short raised railing element connected to the lower portions of each of the support arm units wherein said railing element extending from said front edge to said rear edge of the base unit, and at least a selected one of said front and rear edges of the base unit to surround the base of the chair on at least three sides.

2. The support device as in claim 1; wherein, the support arm units are vertically adjustable.

3. The support device as in claim 2; wherein, the base unit is laterally adjustable.

4. The support device as in claim 1; wherein, the base unit comprises:

an enlarged generally flat rectangular base member having a top and bottom surface.

5. The support device as in claim 4; wherein, the base member further comprises:

a railing element disposed around at least a portion of the periphery of the base member.

6. The support device as in claim 5; wherein, the railing element is operatively connected to both the base member and the said support arm members.

7. The support device as in claim 4; wherein, the bottom surface of the base member is provided with a coating of high coefficient friction material.

8. The support device as in claim 1; wherein, the support arm units are vertically adjustable.

9. The support device as in claim 8; wherein, the base unit is laterally adjustable.

10. The support device as in claim 1; wherein the base unit further comprises:

a pair of generally flat rectangular base members; and, an intermediate connector element for joining the base members together at a selected distance relative to one another.

11. A support device for use with a conventional chair having opposite sides and a base; wherein, the device comprises:

a generally flat base unit including a pair of generally flat rectangular base members and an intermediate connector element operatively connected to said pair of base members for varying the spacing therebetween; wherein each base member has front, and rear edges as well as exterior and interior side edges;

a pair of generally rectangular adjustable support arm units having upper and lower portions wherein the lower portions are operatively connected proximate to, but spaced from, the opposite sides of the chair; and, a generally short raised railing element operatively connected to the lower portions of the support arm units, and at least a selected one of said front and rear edges of the base unit to surround the base of the chair on at least three sides.

12. The support device as in claim 11; wherein, the support arm units are vertically adjustable.

13. The support device as in claim 12; wherein, the base unit is laterally adjustable.

* * * * *